US009144307B1

(12) United States Patent
Chen

(10) Patent No.: US 9,144,307 B1
(45) Date of Patent: Sep. 29, 2015

(54) CONCEALED SLIDE MODULE

(71) Applicant: SUN CHAIN TRADING CO., LTD, Taipei (TW)

(72) Inventor: Bi-Sha Chen, Taipei (TW)

(73) Assignee: Sun Chain Trading Co., Ltd., Taipei (TW)

( * ) Notice: Subject to any disclaimer, the term of this patent is extended or adjusted under 35 U.S.C. 154(b) by 23 days.

(21) Appl. No.: 14/264,072

(22) Filed: Apr. 29, 2014

(30) Foreign Application Priority Data

Mar. 14, 2014 (TW) ..... 103204394 U

(51) Int. Cl.
*A47B 88/00* (2006.01)
*A47B 88/04* (2006.01)

(52) U.S. Cl.
CPC ..... *A47B 88/0466* (2013.01); *A47B 88/04* (2013.01)

(58) Field of Classification Search
CPC ..... A47B 88/04; A47B 88/0466
USPC ..... 312/334.1, 334.6, 334.8, 334.9, 312/334.11–334.15
See application file for complete search history.

(56) References Cited

U.S. PATENT DOCUMENTS

| | | | | |
|---|---|---|---|---|
| 5,769,518 | A * | 6/1998 | Grabher | 312/334.6 |
| 6,682,160 | B2 * | 1/2004 | Kung | 312/334.6 |
| 8,152,252 | B2 * | 4/2012 | Liang et al. | 312/334.6 |
| 8,277,003 | B2 * | 10/2012 | Milligan et al. | 312/334.6 |
| 2004/0212284 | A1 * | 10/2004 | Fitz | 312/334.13 |
| 2005/0231083 | A1 * | 10/2005 | Garcie, Jr. | 312/333 |
| 2007/0080617 | A1 * | 4/2007 | Lam et al. | 312/334.15 |
| 2011/0037365 | A1 * | 2/2011 | Liang et al. | 312/334.32 |
| 2011/0188788 | A1 * | 8/2011 | Li | 384/19 |
| 2013/0076221 | A1 * | 3/2013 | Hammerle et al. | 312/334.1 |

* cited by examiner

*Primary Examiner* — Daniel Rohrhoff
(74) *Attorney, Agent, or Firm* — Leong C. Lei

(57) ABSTRACT

A concealed slide module is formed by installing an inner plate, at least one first ball plate, a middle plate, at least one second ball plate and an outer plate sequentially and installed between a bottom side of a drawer and a cupboard. The middle plate covers the exterior of the first ball plate and has an inner sidewall facing the inner plate and having a roof portion protruded horizontally outward from the top side of the middle plate, and a sliding section bent inwardly from a lower edge of the sidewall, and the sliding section is parallel to the platform, and a guide wheel is protruded from an outer sidewall at an end of the middle plate, and the middle plate slides with respect to the inner plate through the first ball plate.

4 Claims, 5 Drawing Sheets

CONCEALED SLIDE MODULE

CROSS-REFERENCE TO RELATED APPLICATIONS

This non-provisional application claims priority under 35 U.S.C. §119(a) on Patent Application No(s). 103204394 filed in Taiwan, R.O.C. on Mar. 14, 2014, the entire contents of which are hereby incorporated by reference.

BACKGROUND OF THE INVENTION

1. Field of the Invention

The present invention relates to the technical area of downwardly mounted slides for drawers, and more particularly to a concealed slide module with the design of a middle plate and having a roof portion and a guide wheel on two sidewalls to improve the stability and reliability.

2. Description of the Related Art

In general, a piece of furniture having a drawer such as a file cabinet, a cupboard and a desk usually comes with a pair of slides connected between the drawer and the furniture to facilitate users to push/pull the drawer to shut or open the drawer, and the slides are provided for carrying the load of the drawer and sliding the drawer. The conventional slide module is mainly divided according to its function and appearance into two main types, respectively: a side-mounted slide module and a downwardly mounted slide module. The side-mounted slide module is mounted onto a side of the drawer and coupled to the furniture, and the downwardly mounted slide module (also known as concealed slide module) is mounted onto the bottom of the drawer and coupled to the furniture to provide a concealed form.

When the concealed slide module is used, the weight of the drawer directly presses on the slide module, and thus its force exertion direction differs from that of the side-mounted slide module. In general, the cross-section of the concealed slide module is substantially in a rectangular shape, which is obviously unlike the long flat cross-section of the general slide module, so that the concealed slide module can bear a relatively larger perpendicular weight, and the concealed slide module comes with a ball design that is different from the design of the side-mounted slide module, and related components have been disclosed in U.S. Pat. No. 8,277,003 entitled "Undermount drawer slide" and invented by Charles A. Milligan and U.S. Pat. No. 8,152,252 entitled "Slide assembly" and invented by Ken-Ching Chen, and both of the aforementioned patents are designed with the structure of a middle plate and an outer plate. With reference to FIG. 1 for a schematic view of the structure as disclosed in U.S. Pat. No. 8,277,003, a roof portion 11 is extended outwardly from both sides of a top side of the middle plate 1, and two abutting surfaces 21 disposed on an inner side of the outer plate 2 and opposite to each other, so that the distance between the outermost sides of the two roof portions 11 is greater than the width of an opening of a ball set 3 for preventing the ball set 3 from falling out while sliding and reducing the gap between the ball set 3 and the middle plate 1 to improve the close contact, so as to achieve the effects of enhancing the sliding smoothness and stability.

In addition, an "Undermount drawer slide" as disclosed in U.S. Pat. Publication No. US 2005/0231083 A1 comprises a wheel installed on two sidewalls of the middle plate separately for replacing the extending structure of the roof portion 11 to improve the sliding smoothness, so that a relatively larger gap is formed between the wheels and the outer plate to provide sufficient moving space. However, the drawers may produce vibrations and noises in practical applications.

It is noteworthy that dimensions and symmetrical positions must be taken into consideration for manufacture the drawer slide with of the design of the dual roof portions 11, and thus having a very high level of difficulty of the manufacture and incurring a high manufacturing cost. On the other hand, the dual wheel design comes with a too-large gap, and thus causing vibrations and noises easily. Obviously, the conventional drawer slides require further improvements.

SUMMARY OF THE INVENTION

In view of the problems of the prior art, it is a primary objective of the present invention to overcome the problems of the prior art by providing a concealed slide module, wherein a roof portion is disposed on a sidewall of a middle plate, and a guide wheel is installed on the other sidewall of the middle plate. Therefore, the two roof portions formed and bent from symmetrical positions of the two sidewalls of the middle plate are no longer required, and the level of difficulty of the manufacture and the manufacturing cost can be lowered. In addition, design of the guide wheel can guide an outer plate to move accordingly to achieve the effects of minimizing the gap of the assembly, improving the stability, reducing noises, and preventing the drawer slides from falling out. In addition, the guide wheel further acts as a stop structure between the middle plate and the outer plate to prevent these plates from falling out during use.

To achieve the aforementioned objective, the present invention provides a concealed slide module installed between a bottom side of a drawer and a cupboard, comprising:

an inner plate, having a folded plate disposed on a side of the inner plate and installed on an inner side of the cupboard, and a connecting section bent perpendicularly upward from the inner plate opposite to the other edge of the folded plate, and a platform formed and bent from the top of the connecting section, so that the platform and the bottom side of the inner plate are parallel to each other;

at least one first ball plate, covered onto an outer side of the platform, and the first ball plate including a first stand and a plurality of first rollers, and the first rollers being installed at a top side, a bottom side and an outer side of the first stand separately;

a middle plate, covered onto the exterior of the first ball plate, and having a roof portion facing towards an inner sidewall of the inner plate and protruded outwardly in a horizontal direction of the top side, a sliding section inwardly bent from a lower edge of the inner sidewall such that the sliding section and the platform are parallel to each other, and a guide wheel protruded from an outer sidewall at an end of the middle plate, and the middle plate sliding through the first ball plate with respect to the inner plate;

at least one second ball plate, covered onto the exterior of the middle plate, and the second ball plate including a second stand, a plurality of second balls and a plurality of second rollers, and the second stand being an inverted U-shaped structure, and the second balls being installed on two lateral sides of the second stand, and the second rollers being installed at the top side of the second stand; and an outer plate, installed at the bottom side of the drawer, and the outer plate being an inverted U-shaped structure covered onto the exterior of the second ball plate, and an anti-loose portion being inwardly protruded from edges of the two sidewalls of the outer plate separately, such that the first balls and the guide wheel are coupled to the two anti-loose portions, and the outer plate slides with respect to the middle plate through the second ball plate and the guide wheel.

In a preferred embodiment, the guide wheel has a protruding length equal to the distance between the middle plate and the outer plate, and the guide wheel has a diameter equal to the distance between the axis of the guide wheel and the anti-loose portion. In addition, the bottom side of the roof portion is in a cambered shape corresponsive to the second ball and disposed opposite to the anti-loose portion for clamping the second ball therebetween. The outer sidewall of the bottom of the guide wheel has a section deviated to the outside, so that the first rollers are coupled to surfaces of the middle plate and the connecting section respectively. The invention can minimize the gap produced after the assembling process to prevent producing vibrations or noises easily when the concealed slide module performs an extending or contracting movement.

DETAILED DESCRIPTION OF THE PREFERRED EMBODIMENTS

The technical content of the present invention will become apparent with the detailed description of preferred embodiments and the illustration of related drawings as follows.

Figure 1:
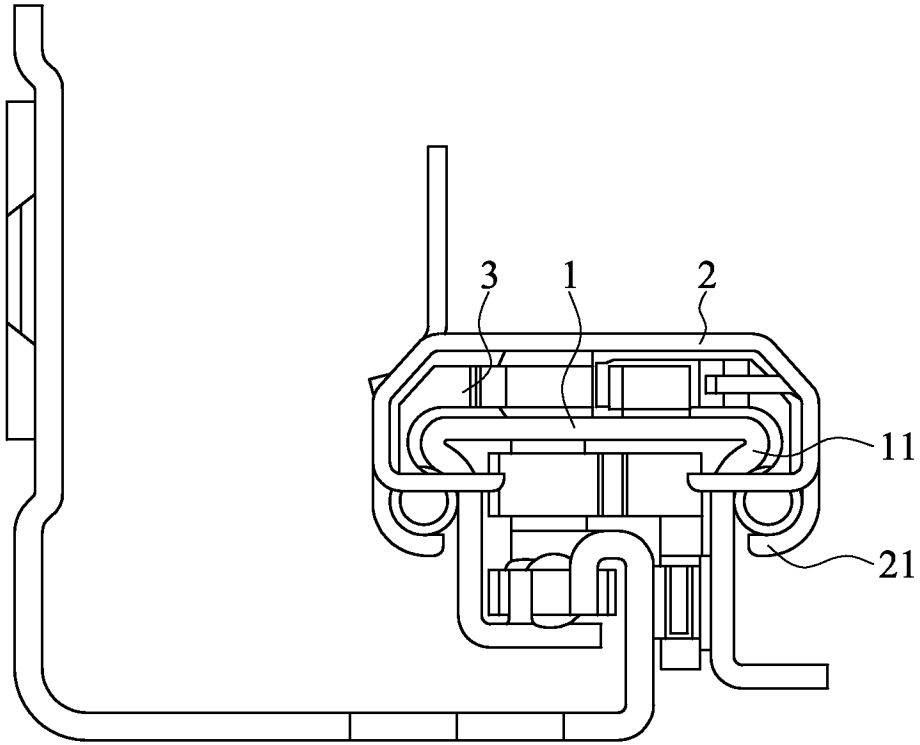
FIG. 1 (PRIOR ART)
FIG. 1 is a schematic view of the structure as disclosed in U.S. Pat. No. 8,277,003.
Figure 2:
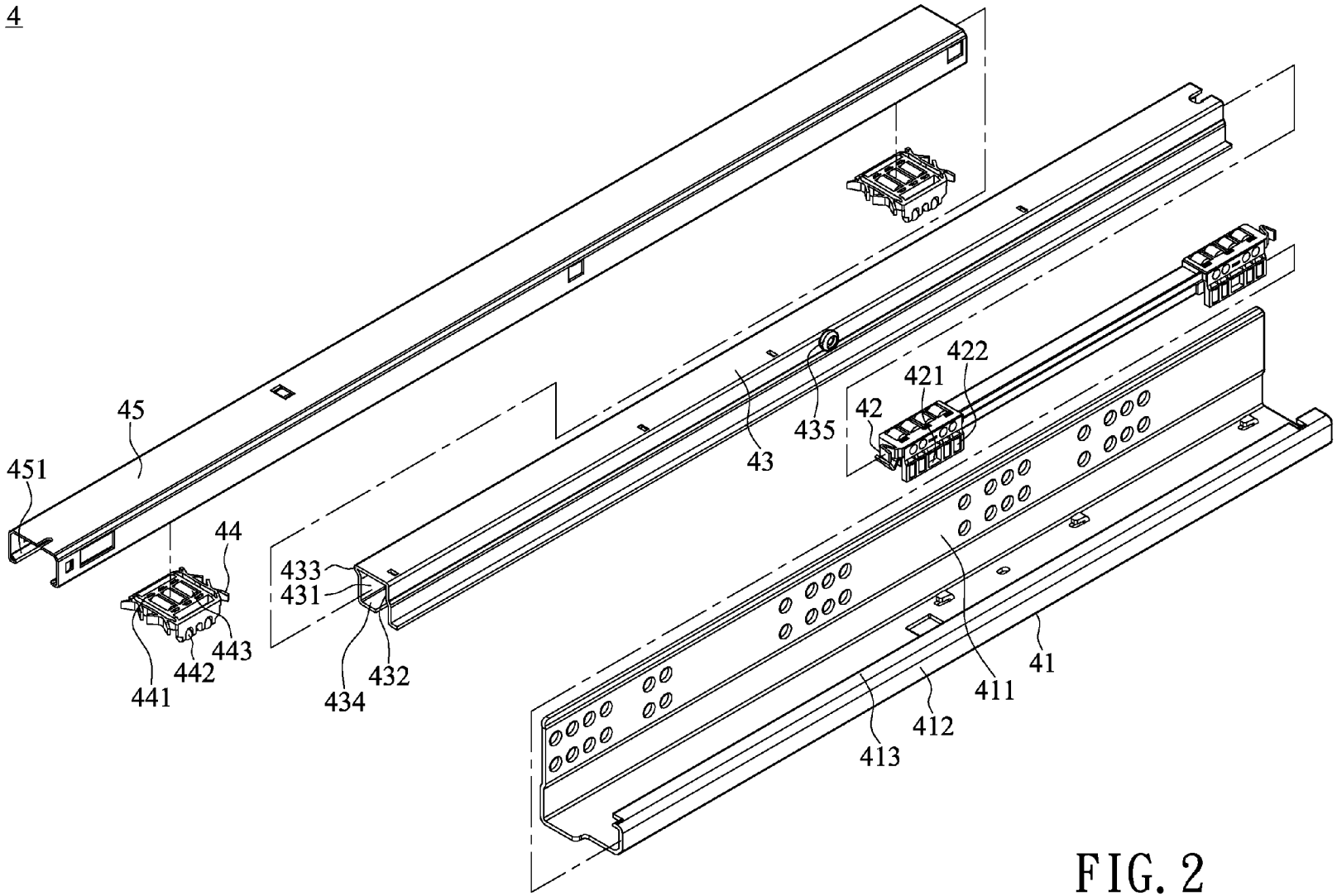
FIG. 2 is an exploded view of a preferred embodiment of the present invention.
Figure 3:
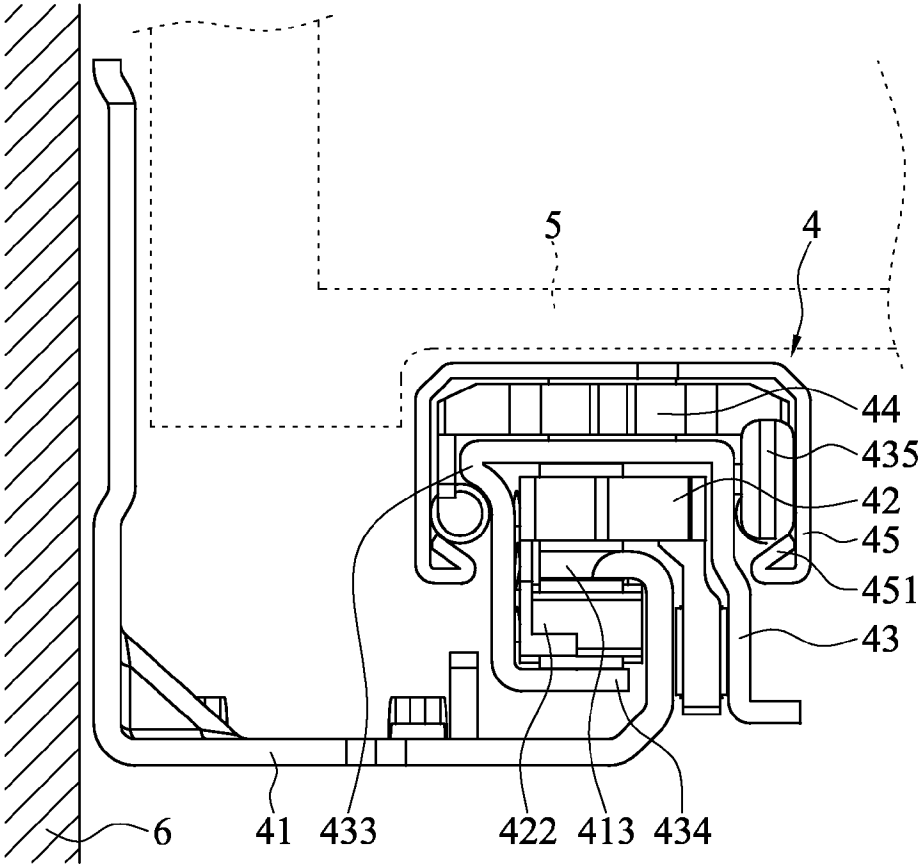
FIG. 3 is a cross-sectional view of a preferred embodiment of the present invention.
Figure 4:
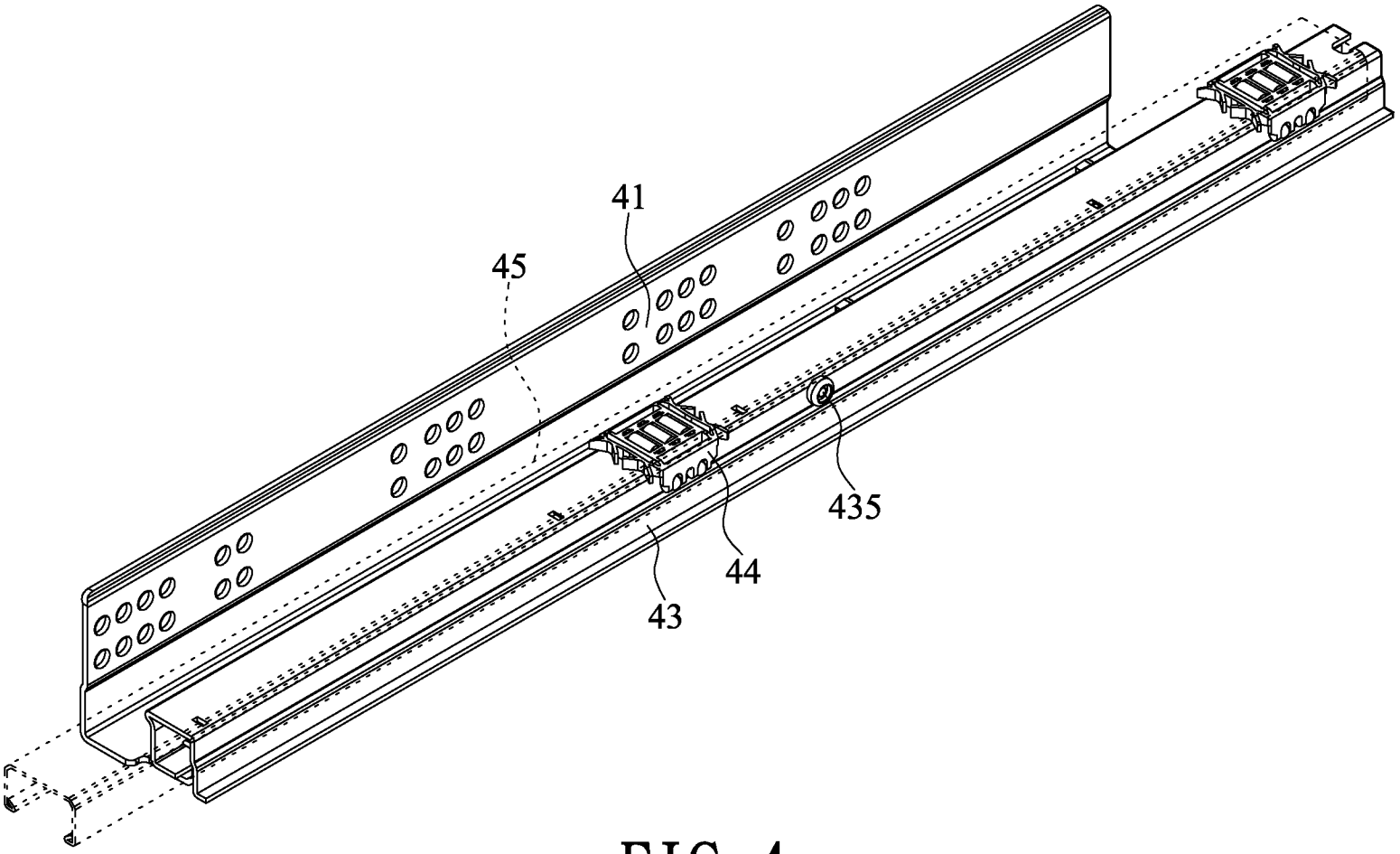
FIG. 4 is a first schematic view of a using status of a preferred embodiment of the present invention.
Figure 5:
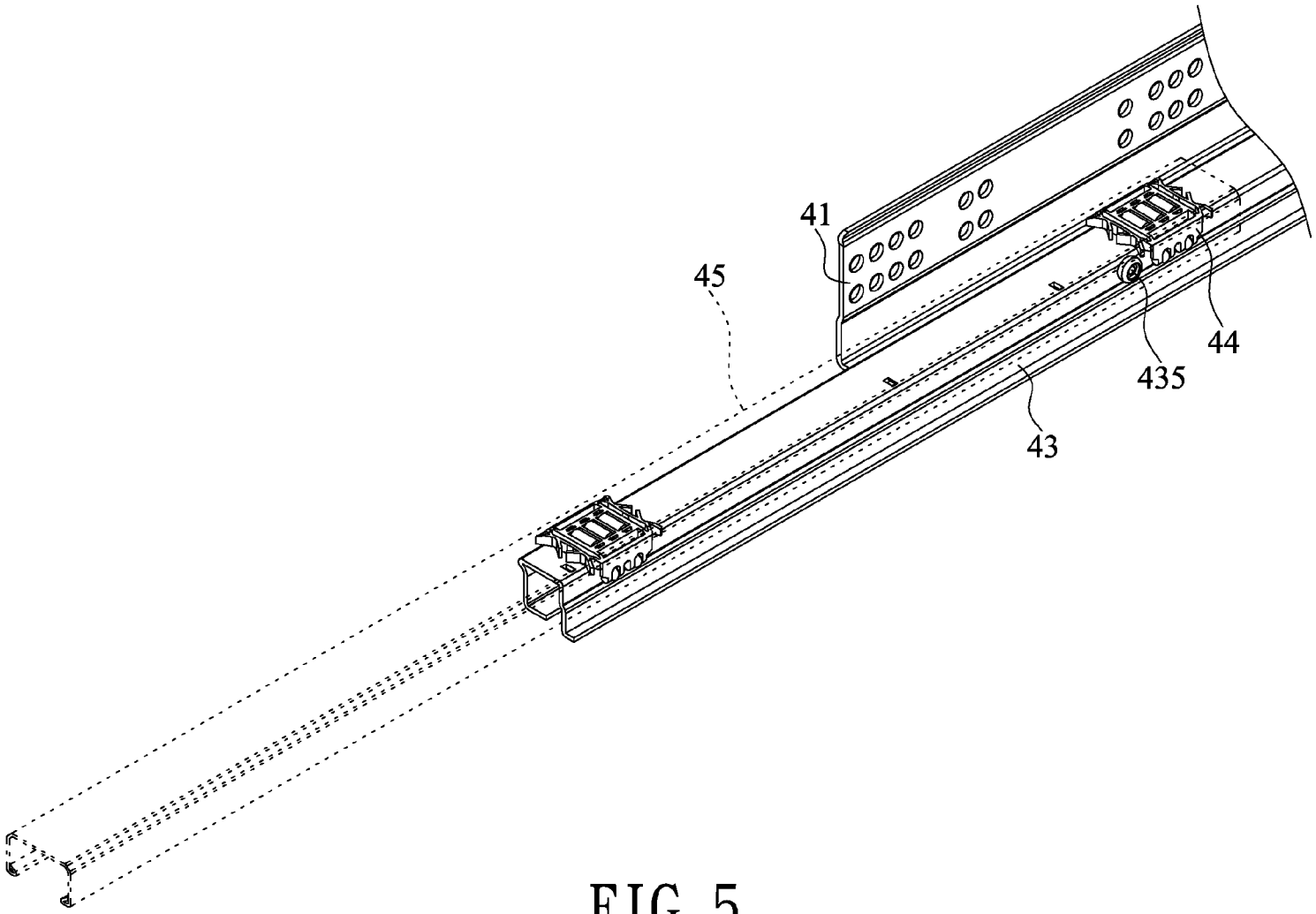
FIG. 5 is a second schematic view of a using status of a preferred embodiment of the present invention.

With reference to FIGS. 2 to 4 for an exploded view, a cross-sectional view and a schematic view of a using status of a concealed slide module in accordance with a preferred embodiment of the present invention respectively, the concealed slide module 4 comprises an inner plate 41, a pair of first ball plates 42, a middle plate 43, a pairs of second ball plates 44 and an outer plate 45, installed between a bottom side of a drawer 5 and a cupboard 6.

Wherein, the inner plate 41 is a structure made of a metal sheet and bent into the structure with a substantially L-shaped cross-section, and a side of the inner plate has a folded plate 411 provided for installing to an inner side of the cupboard 6, and the inner plate 41 has a connecting section 412 bent perpendicularly upward from the other edge of the folded plate 411, a platform 413 bent from the top of the connecting section 412, so that the platform 413 and the bottom side of the inner plate 41 are parallel to each other.

Each first ball plate 42 is covered onto an outer side of the platform 413, and each first ball plate 42 includes a first stand 421 and a plurality of first rollers 422, and the first rollers 422 are substantially cylindrical structures and movably installed at a top side, a bottom side and an outer side of the first stand 421 respectively such that the first rollers 422 disposed at the top side of the first stand 421 abuts the platform 413, and the first rollers 422 disposed at the bottom side of the first stand 421 bottom side abuts the bottom side of the platform 413, and the first rollers 422 disposed at the outer side of the first stand 421 abuts the outer side of the connecting section 412.

The middle plate 43 is also made of a metal sheet and bent into the structure with a substantially inverted U-shaped cross-section for covering onto the exterior of the first ball plate 42, wherein a side of the middle plate 43 facing the inner plate 41 is called an inner side, and the other side is called an outer side, so that an inner sidewall 431 is formed on a side facing the inner side of the middle plate 43, and an outer sidewall 432 is formed on a side facing the outer side, and the inner sidewall 431 has a roof portion 433 protruded horizontally outward along the top side of the middle plate 43, and a sliding section 434 is bent inwardly from a lower edge of the inner sidewall 431, and the sliding section 434 and the platform 413 are parallel to each other and disposed with a gap apart from each other, and the gap is equal to the size of the first roller 422. In addition, a guide wheel 435 is protruded from the outer sidewall 432 of the middle plate 43, and the middle plate 43 slides with respect to the inner plate 41 through the first ball plate 42.

Each second ball plate 44 is covered onto the exterior of the middle plate 43, and each second ball plate 44 includes a second stand 441, a plurality of second balls 442 and a plurality of second rollers 443, wherein the second stand 441 is a substantially inverted L-shaped structure corresponsive to the middle plate 43, and the second balls 442 are substantially spherical structures, and the second rollers 443 are also cylindrical structures, and the second balls 442 are movably installed on both lateral sides of the second stand 441, and the second rollers 443 are movably installed on the top side of the second stand 441.

The outer plate 45 is installed at the bottom side of the drawer 5, and the outer plate 45 is made of a metal sheet and bent into an inverted U-shaped structure for covering the exterior of the second ball plate 44, and an anti-loose portion 451 is protruded inwardly and separately from edges of two sidewalls of the outer plate 45. After the assembling process, the second balls 442 and the guide wheel 435 abut the two anti-loose portions 451 respectively, and the two anti-loose portions 451 are substantially in a triangular shape, and an oblique surface is formed on a side facing the interior for sliding the second ball plate 44, and the outer plate 45 slides with respect to the middle plate 43 through the second ball plate 44 and the guide wheel 435, so that the concealed slide module 4 of the present invention can be extended or retracted to a length of two stages. In addition, the guide wheel 435 can be used as a stop structure between the middle plate 43 and the outer plate 45 for preventing the outer plate 45 from falling out when the drawer 5 is pulled out.

It is noteworthy that protruding length of the guide wheel 435 of the present invention is designed to be exactly equal to the distance between the middle plate 43 and the outer plate 45 to improve the stability of use and reduce vibrations and noises produced in the sliding process. In addition, the diameter of the guide wheel 435 is designed to be exactly equal to the distance from the axis of the guide wheel 435 to the anti-loose portion 451. In addition, the bottom side of the roof portion 433 is in a cambered shape corresponsive to the second ball 442 and opposite to the anti-loose portion 451 for clamping the second ball therebetween. In addition, a section of the outer sidewall 432 under the guide wheel 435 is deviated outwardly, so that the first rollers 422 abut surfaces of the middle plate 43 and the connecting section 412 to reduce the gap after the assembling takes place to prevent the outer plate 45 from producing vibrations and noises when the middle plate 43 slides or the middle plate 43 slides with respect to the inner plate 41.

What is claimed is:

1. A concealed slide module, installed between a bottom side of a drawer and a cupboard, comprising:

an inner plate, having a folded plate disposed on a side of the inner plate and installed on an inner side of the cupboard, and a connecting section bent perpendicularly upward from the inner plate opposite to the other edge of the folded plate, and a platform formed and bent from the top of the connecting section, so that the platform and the bottom side of the inner plate are parallel to each other;

at least one first ball plate, covered onto an outer side of the platform, and the first ball plate including a first stand and a plurality of first rollers, and the first rollers being installed at a top side, a bottom side and an outer side of the first stand separately;

a middle plate, covered onto the exterior of the first ball plate, and having a roof portion facing towards an inner sidewall of the inner plate and protruded outwardly in a horizontal direction of the top side, a sliding section inwardly bent from a lower edge of the inner sidewall such that the sliding section and the platform are parallel to each other, and a guide wheel protruded from an outer sidewall at an end of the middle plate, and the middle plate sliding through the first ball plate with respect to the inner plate;

at least one second ball plate, covered onto the exterior of the middle plate, and the second ball plate including a second stand, a plurality of second balls and a plurality of second rollers, and the second stand being an inverted U-shaped structure, and the second balls being installed on two lateral sides of the second stand, and the second rollers being installed at the top side of the second stand; and an outer plate, installed at the bottom side of the drawer, and the outer plate being an inverted U-shaped structure covered onto the exterior of the second ball plate, and an anti-loose portion being inwardly protruded from edges of the two sidewalls of the outer plate separately, such that the first balls and the guide wheel are coupled to the two anti-loose portions, and the outer plate slides with respect to the middle plate through the second ball plate and the guide wheel.

2. The concealed slide module of claim 1, wherein the guide wheel has a protruding length equal to the distance between the middle plate and the outer plate, and the guide wheel has a diameter equal to the distance between the axis of the guide wheel and the anti-loose portion.

3. The concealed slide module of claim 2, wherein the bottom side of the roof portion is in a cambered shape corresponsive to the second ball and disposed opposite to the anti-loose portion for clamping the second ball therebetween.

4. The concealed slide module of claim 3, wherein the outer sidewall of the bottom of the guide wheel has a section deviated to the outside, so that the first rollers are coupled to surfaces of the middle plate and the connecting section respectively.

* * * * *